US006883525B2

(12) United States Patent
Lee et al.

(10) Patent No.: US 6,883,525 B2
(45) Date of Patent: Apr. 26, 2005

(54) HAIR EXTENSION DEVICE

(75) Inventors: John S. Lee, Irvine, CA (US); Su-Jin Lee, Irvine, CA (US)

(73) Assignee: Soho, Inc., Los Angeles, CA (US)

( * ) Notice: Subject to any disclaimer, the term of this patent is extended or adjusted under 35 U.S.C. 154(b) by 143 days.

(21) Appl. No.: 10/438,133

(22) Filed: May 14, 2003

(65) Prior Publication Data

US 2004/0226571 A1 Nov. 18, 2004

(51) Int. Cl.[7] ..... A41G 3/00; A41G 5/00
(52) U.S. Cl. ..... 132/53; 132/201
(58) Field of Search ..... 132/201, 53, 54, 132/55, 56

(56) References Cited

U.S. PATENT DOCUMENTS 250,967 A * 12/1881 Presser ..... 132/53
794,479 A * 7/1905 Austin ..... 132/201
966,110 A * 8/1910 Matthaus ..... 132/53
1,549,334 A * 8/1925 Ruffio ..... 132/201
3,434,481 A * 3/1969 Mazzocco ..... 132/53
3,955,587 A * 5/1976 Dunn et al. ..... 132/201
5,873,373 A * 2/1999 Narvick ..... 132/54

* cited by examiner

*Primary Examiner*—John J. Wilson
*Assistant Examiner*—Robyn Doan
(74) *Attorney, Agent, or Firm*—Dan M. De La Rosa

(57) ABSTRACT

The invention provides for a hair extension device and a method of manufacture of the hair extension device. The hair extension device includes at least one length of hair attached to a bendable wire and a comb attached to the wire. The method of manufacture provides the steps for attaching the hair to the formable wire and attaching the formable wire to a comb.

20 Claims, 2 Drawing Sheets

HAIR EXTENSION DEVICE

FIELD OF THE INVENTION

This invention relates generally to hair pieces. More specifically, the invention relates to hair extension devices for providing fuller and more appealing looking hair designs.

BACKGROUND OF THE INVENTION

Hair pieces and hair extensions are well known in the cosmetic industry. Hair pieces are commonly used by individuals with thin hair to provide a fuller and, often, a more appealing look. Hair extensions are also often used to provide a fuller looking heads of hair. However, hair extensions are also used cosmetically to allow the user to change their hair style quickly and without having to wait for their natural hair to grow to the required length in order to obtain the desired style.

Known forms of hair extensions include hair attached to clips, combs and elastic bands. These hair extensions may be arranged in and around the natural hair. However, many of these devices require a great deal of skill to properly arrange on the head in an unobtrusive manner. In addition, some devices are hard to keep secured on the head during times of physical exertion such as, for example, during exercise routines, running and dancing the jitterbug.

One example of a known hair extension device, often referred to as a scrunchy, attaches hair to an elastic band. The band is then wound around a ponytail formed on the users head from the natural hair. The elastic of the scrunchy acts much like a rubber band would for securing a ponytail. The hair attached to the elastic may then be left to hang loose or gathered to form a bun. The scrunchy device, though, tends to slip during physical activity causing the users hair to become tangled. In addition, the elastic tends to lose its elasticity over time, making the device ineffective for its intended use.

It would be desirable, therefore, to provide a hair extension device that overcomes these and other disadvantages.

SUMMARY OF THE INVENTION

The invention provides for a hair extension device comprising a comb, a bendable member attached to the comb and at least one length of hair attached to the bendable member.

The invention further provides a method for manufacturing a hair extension device. The method comprises forming at least one length of hair from a plurality of individual strands of hair; securing an end of a first length of hair to a first end of a bendable member; wrapping the first length of hair around the bendable member a first distance extending from the first end; securing an end of a second length of hair to a second end of the bendable member; wrapping the second length of hair around the bendable member a second distance extending from the second end; and securing a comb to the bendable member between the first length of hair and the second length of hair.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

DETAILED DESCRIPTION OF THE PRESENTLY PREFERRED EMBODIMENTS

Figure 1:
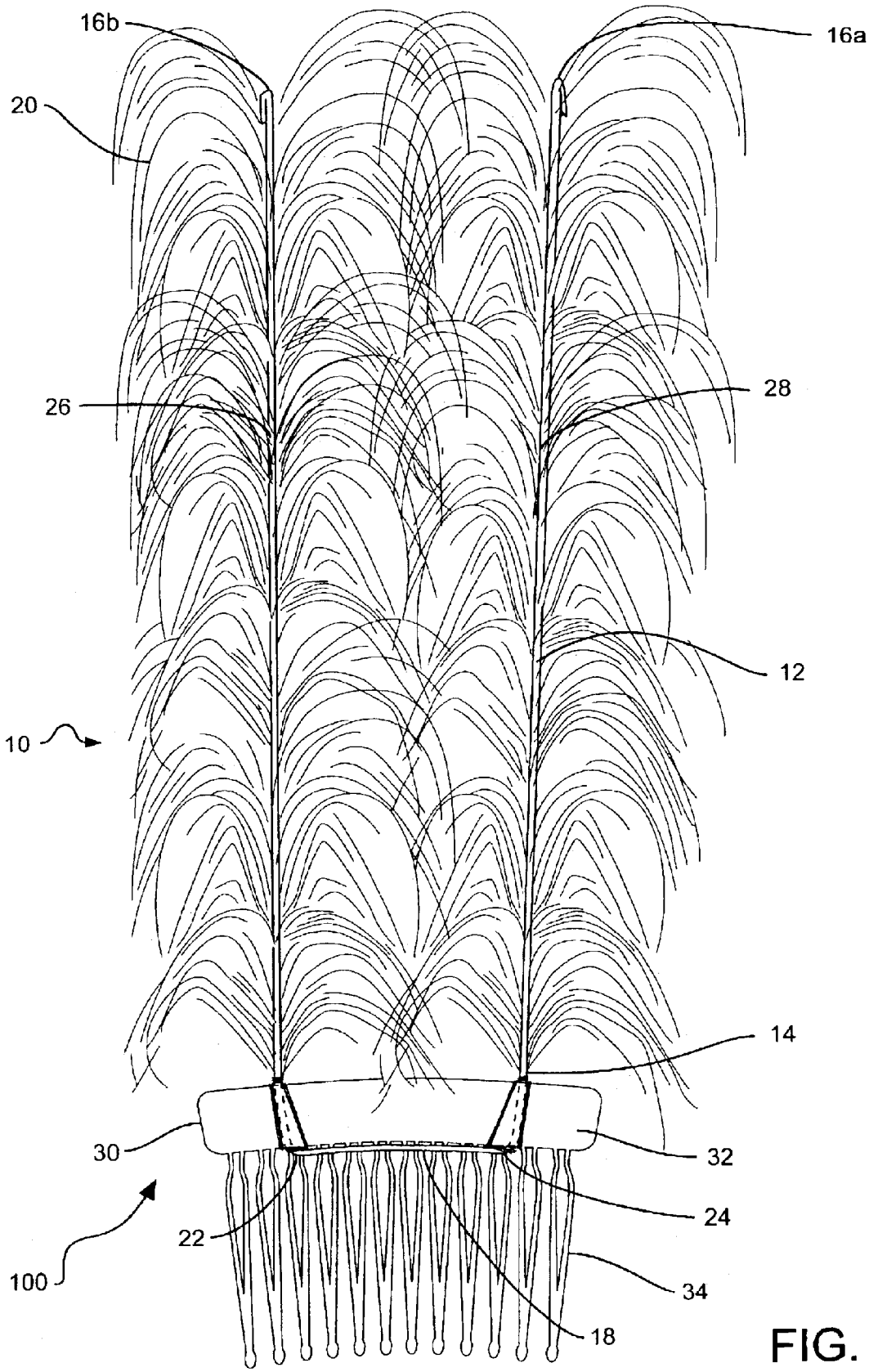
FIG. 1 illustrates one embodiment of a hair extension device in accordance with the invention.
Figure 2:
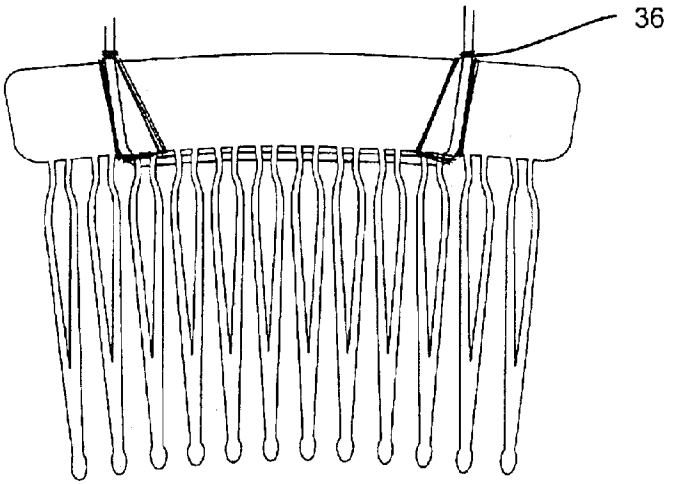
FIG. 2 illustrates a detail of the device illustrated in FIG. 1.

Referring now to FIGS. 1 and 2, one embodiment of a hair extension device in accordance with the present is shown generally at 100. Hair extension 100 includes a hair assembly 10 and a comb 30. Hair assembly 10 includes bendable member 12 and hair 20. In one embodiment, hair 20 is synthetic hair. In another embodiment, hair 20 is real hair. Hair 20 may be dyed various colors to approximate natural hair colors or, alternatively, may be dyed bright unnatural colors that are well known in the art. Hair 20 is attached to bendable member 12 by an exemplary method described below.

In the embodiment illustrated in FIG. 1, bendable member 12 is divided into three portions, hair attachment portions 26, 28 and comb attachment portion 18. Comb attachment portion 18 is positioned between hair attachment portions 26 and 28. Hair attachment portions 26, 28 may be of various lengths, the length depending on the style of hair extension desired. In one embodiment, bendable member 12 is a formable metal wire. In another embodiment, bendable member 12 may be, for example, formable plastic. In another embodiment, bendable member 12 may comprise a formable metal wire having a coating. The coating may be, for example, a plastic or a rubber coating.

Figure 4:
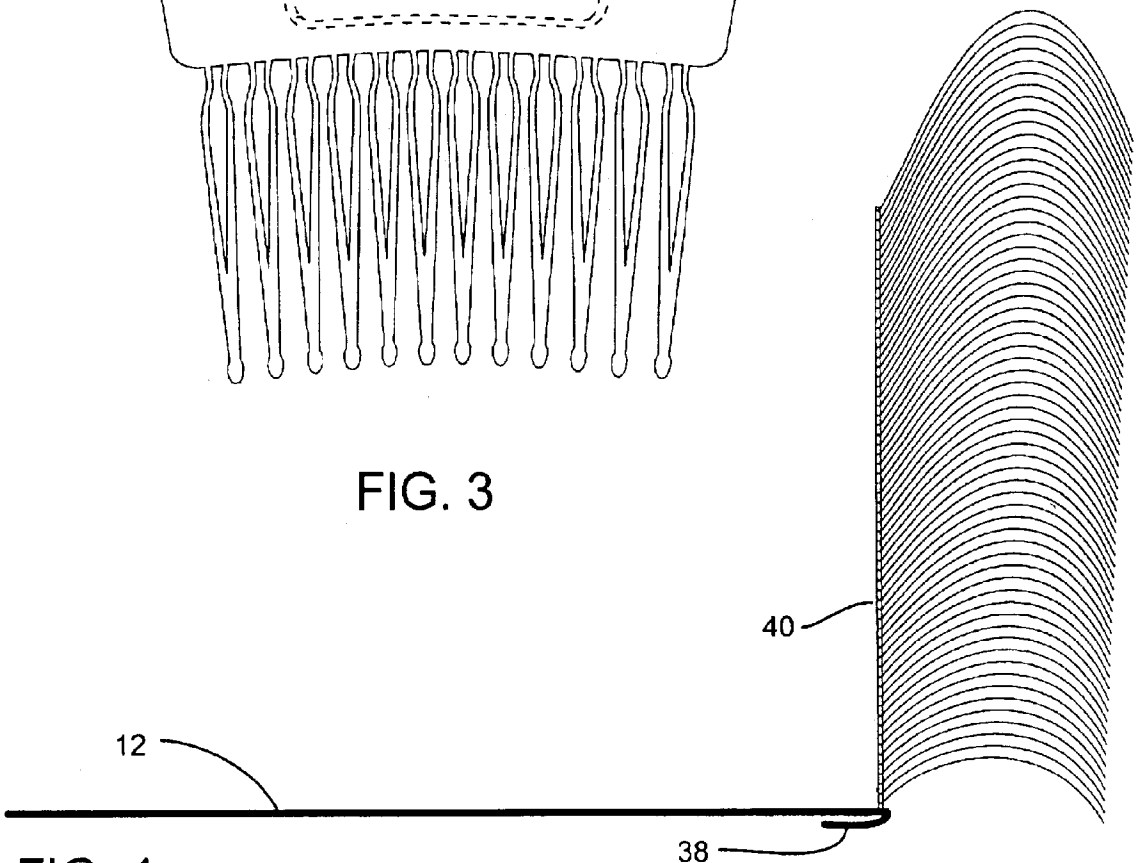
FIG. 4 illustrates a detail of a portion of the hair extension device illustrated in FIG. 1.

The embodiment illustrated in FIG. 1 shows a bendable member 12 having an end 16 that is blunt. In one embodiment illustrated in FIG. 4, the blunt end is fashion in a hook-like manner 38. Those skilled in the art will recognize other configurations to provide a blunt end for bendable member 12. For example, the end may be capped using a small plastic cap that is inconspicuous to the user.

Comb 30 includes body portion 32 and a plurality of teeth 34 extending from body portion 32 in a manner that is well known in the art. Comb 30 may be formed from plastic, metal, bone, shell or any other suitable material known in the art.

Hair extension device 100 may be fashioned in the following manner. First, strands of hair 20 are sewn together, in a manner that is well known in the art, to form a length of hair 40. In one embodiment, the hair is curled once it is formed into the length of hair. Those skilled in the art will recognize that various types of hair may be used to form the length of hair. For example, the hair may be straight, curly, or wavy. The hair may also be of various lengths depending on the desired style.

Second, one end of the length of hair 40 is securely attached to end 16*a* of bendable member 12. The hair 40 may be secured to end 16*a* by any means known in the art, such as, for example, glue. Once the end of hair 40 is attached, the length of hair is wrapped around the first hair attachment portion 26 of bendable member 12. The length of hair 40 is wrapped around bendable member 12 until it reaches comb attachment portion 18 of bendable member 12. Comb attachment portion 18 of bendable member 12 is not covered by hair 40. This procedure is repeated for the second hair attachment portion 28 beginning at end 16*b*. Those skilled in the art will recognize that there are other methods known in the art suitable for attaching the hair to device 100.

Once both of the hair attachment portions 26, 28 are covered with hair 40, comb attachment portion 18 of bendable member 12 is bent to form two spaced apart angles 22, 24. Comb 30 is then disposed on comb attachment portion 18 of bendable member 12. The comb 30 may then be secured to the bendable member 12. FIGS. 1 and 2 illustrate that comb 30 is secured to bendable member 12 using thread 36. Those skilled in the art will recognize that there are other methods of securing the comb 30 to the bendable member 12 such as, for example, by gluing or thin gauge wire.

In practice, the user of the hair extension device may, first, form their natural hair into a ponytail. The user then secures the hair extension device on the head by inserting the comb into the hair near the ponytail. Once secured, the user then forms the bendable members in and around the ponytail. The hair of the hair extension device may then be styled according to the desires of the user.

Figure 3:
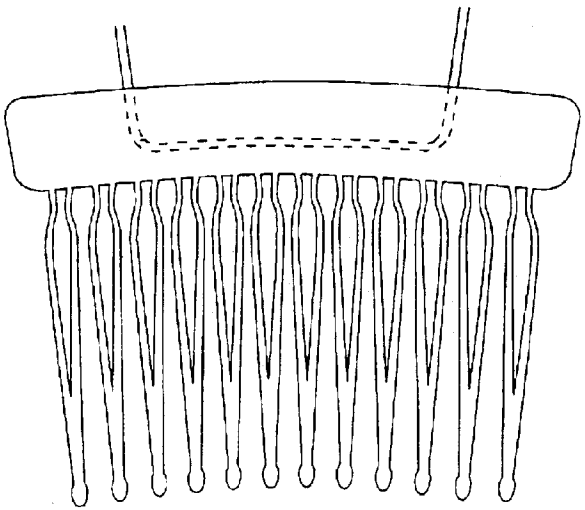
FIG. 3 illustrates another embodiment of the hair extension device according to the present invention.

Those skilled in the art will recognize that hair extension device 100 may be fashioned in other manners. For example, the comb attachment portion of bendable member 12 may be an integral part of the comb as illustrated in FIG. 3. Other embodiments may attach the bendable member to a barrette-type device instead of a comb.

Therefore, while the embodiments of the present invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. A hair extension device comprising:

a comb comprising at least one tooth and having opposing ends, said tooth being situated at a first end of said comb;

at least one bendable member comprising first and second hair attachment portions and a comb attachment portion disposed between said first and second hair attachment portions, each of said hair attachment portions having at least two side surfaces; and at least one length of hair attached to said side surfaces of each of said first and second hair attachment portions of said bendable member, a part of said comb attachment portion being attached to a second end of said comb, said comb attachment portion being free of any hair and wherein said first and second hair attachment portions of said bendable member extends outwardly from said second end of said comb and can be bended and shaped by the user to provide for a plurality of hairstyles.

2. The device of claim 1 wherein the length of hair is comprised of a plurality of individual strands of hair sewn together to form the length of hair.

3. The device of claim 2 wherein the plurality of individual strands of hair is curled prior to being secured on the bendable member.

4. The device of claim 1 wherein the bendable member is constructed of a material selected from a group consisting of formable wire, formable rubber, formable plastic and mixture thereof.

5. The device of claim 4 wherein the formable wire is coated with rubber.

6. The device of claim 1 wherein the comb is constructed of a material selected from a group consisting of metal, plastic, bone, shell and mixtures thereof.

7. The device of claim 1 wherein the hair is attached to the bendable member by wrapping the at least one length of hair around the bendable member.

8. The device of claim 1 wherein the comb is secured to the bendable member by one of the following selected from a group consisting of glue, thread, string, wire and mixtures thereof.

9. The device of claim 1 wherein the comb comprises a body portion and the bendable member is attached to the body portion of the comb.

10. The device of claim 9 wherein the bendable member is integral to the body portion of the comb.

11. The device of claim 1 wherein the at least one length of hair is selected from a group consisting of real human hair, real animal hair, synthetic hair and mixtures thereof.

12. A method of manufacturing a hair extension device, the method comprising:

forming at least one length of hair from a plurality of individual strands of hair;

securing an end of a first length of hair to a first end of a bendable member;

wrapping the first length of hair around the bendable member a first distance extending from the first end;

securing an end of a second length of hair to a second end of the bendable member;

wrapping the second length of hair around the bendable member a second distance extending from the second end; and securing a comb to the bendable member between the first length of hair and the second length of hair.

13. A hair extension device comprising:

a comb comprising at least one tooth and having opposing ends, said tooth being situated at a first end of said comb;

at least one elongated bendable member having opposing ends and a central section, each of said opposing ends having at least two side surfaces; and at least one length of hair attached to each of said side surfaces of each of said opposing ends of said bendable member, at least a portion of said central section being attached to a second end of said comb, said central section being free of any hair, and said opposing ends of said bendable member extend outwardly from said second end of said comb and are designed to be bent and shaped by the user to provide for a plurality of hairstyles.

14. The device of claim 13 wherein the length of hair is comprised of a plurality of individual strands of hair sewn together to form the length of hair.

15. The device of claim 14 wherein the plurality of individual strands of hair is curled prior to being secured on said hair holding means.

16. The device of claim 13 wherein said comb is constructed of a material selected from a group consisting of metal, plastic, bone, shell and mixtures thereof.

17. The device of claim 13 wherein said hair is attached to said opposing ends of said bendable member by wrapping said length of hair around said opposing ends of said bendable member and said comb is secured to said hair holding means by use of glue, thread, string, wire and mixtures thereof.

18. A hair extension device comprising:

a comb comprising at least one tooth and having opposing ends, said tooth being situated at a first end of said comb;

at least two bendable members having two ends, a first end of each of said bendable members being attached to a second end of said comb and a second end of each of said bendable members having at least two side surfaces and at least one length of hair is attached to both side surfaces of each of said second ends of said bendable members, each of said second ends of said bendable members extends outwardly from said second end of said comb; and a connector situated between said first ends of said first and second bendable members, said connector being free of any hair.

19. The device of claim 18 wherein at least a portion of said connector is attached to said comb and said bendable members are designed to be bent and shaped by the user to provide for a plurality of hairstyles.

20. The device of claim 18 wherein said length of hair is comprised of a plurality of individual strands of hair sewn together to form the length of hair.

* * * * *